United States Patent [19]

Fowler et al.

[11] 3,981,415

[45] Sept. 21, 1976

[54] DISPENSER WITH EXPANSIBLE MEMBER AND CONTRACTING FABRIC

[75] Inventors: John Rayford Fowler, Wilmington, Del.; Edward Merrick Hogan, Landenberg, Pa.

[73] Assignee: E. I. Du Pont de Nemours and Company, Wilmington, Del.

[22] Filed: Oct. 29, 1975

[21] Appl. No.: 626,964

[52] U.S. Cl. ..... 222/95; 222/105; 222/107; 222/215

[51] Int. Cl.[2] ..... B65D 35/28; B65D 35/56

[58] Field of Search ..... 222/95, 107, 215, 336, 222/105

[56] References Cited

UNITED STATES PATENTS

| | | | |
|---|---|---|---|
| 1,857,797 | 5/1932 | Van Ness | 222/336 |
| 2,816,690 | 12/1957 | Lari | 222/215 X |
| 2,966,282 | 12/1960 | Geisler | 222/215 X |

*Primary Examiner*—Allen N. Knowles
*Assistant Examiner*—Hadd Lane

[57] ABSTRACT

A fluid dispensing container of the volume-expansible bag type is provided wherein the force for dispensing fluid is provided by the contracting force of an expansible fabric having elastomer yarn in the direction of contraction disposed about the volume-expansible bag.

10 Claims, 7 Drawing Figures

DISPENSER WITH EXPANSIBLE MEMBER AND CONTRACTING FABRIC

BACKGROUND OF THE INVENTION

1. Field of the Invention

The present invention is directed to nonaerosol fluid dispensing containers and more particularly to an expansible fabric for providing the force which dispenses the fluid from the container.

2. Description of the Prior Art

Aerosol fluid dispensing containers may comprise a volume-expansible member such as the accordion-type bags of U.S. Pat. Nos. 3,467,283 and 3,731,854 which expand to be filled with fluid and contract to dispense the fluid. The contracting force is provided by compressed propellant gases such as fluorocarbons, hydrocarbons, and carbon dioxide. Such containers have one or more of the disadvantages of the effect of the gas on the fluid being dispensed, of requiring expensive construction to preserve the gas pressure, of disposal, and of alleged harm to the environment.

Non-aerosol fluid dispensing containers have been proposed in U.S. Pat. Nos. 3,791,557 and 3,876,115 wherein the volume-expansible member is an elastomer bag and the contracting force on the bag is provided by the contraction of a second elastomer bag against the fluidcontaining bag. The difficulty with this approach has been that a second elastomer bag of sufficient recovery force and at a reasonable cost has not been available.

SUMMARY OF THE INVENTION

The present invention provides a fluid dispensing container comprising a volume-expansible means for receiving and holding said fluid and means for forcing said volume-expansible member to contract in volume so as to dispense said fluid therefrom, the improvement comprising an expansible fabric disposed about said volume-expansible member and having a uni-directional recovery force to contract said volume expansible member sufficiently to substantially empty it of said fluid, thereby serving as said forcing means, said fabric comprising elastomer yarn supplying said recovery force to said fabric and yarn in engagement with said elastomer yarn to maintain the position of said elastomer yarn in the fabric during expansion and contraction of said fabric so as to prevent blow-out of said volume-expansible member.

The recovery force of the fabric is the force exerted by the fabric in contracting after having been previously expanded. The measurement of recovery force will be described hereinafter. The uni-directionality of the recovery force of the fabric means that substantially all of the force exerted in the contraction of the fabric is exerted in one direction as compared to the transverse direction of the fabric. This uni-directionality comes about by the manner in which the elastomer yarn and the other mentioned yarn are incorporated into the fabric, or in other words, fabric construction, as will be described in greater detail hereinafter.

Since the force to contract the volume expansible member to dispense the fluid is supplied by the recovery force of the expansible fabric, then an aerosol propellant gas is not necessary. The advantage of the expansible fabric over the second elastomer bag approach of the prior art is that the desired recovery force can be built into the fabric in the direction only where it is needed, by the amount and type of elastomer yarn used in that direction, without the need for the expense of achieving any recovery force in the transverse direction.

The present invention will be explained in greater detail hereinafter with reference to the drawings.

DETAILED DESCRIPTION OF THE INVENTION

Figure 1:
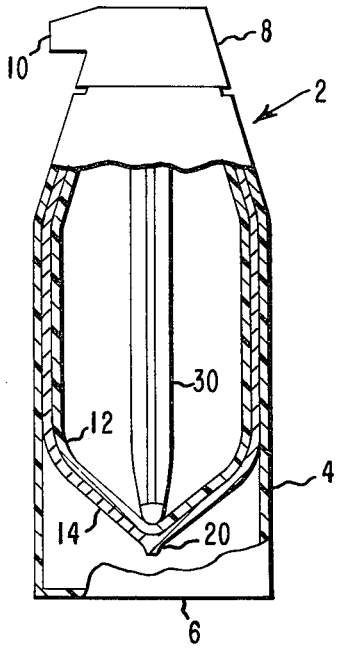
FIG. 1 shows in side elevation one embodiment of a fluid dispensing container of the present invention, with part of the exterior cut away so as to reveal the interior of the container.

The fluid dispensing container of the present invention will first be described with reference to the embodiment shown in FIG. 1. FIG. 1 shows a fluid dispensing container 2 for hand holding, comprising conventional exterior components, i.e., a cylindrical sidewall 4 and bottom 6, and a depressible cap 8 which releases the fluid from within the container through nozzle 10 which forms a part of the cap 8. Further details on these components and the interior valve mechanism (not shown) which is actuated by depression of the cap or similar depressible member are disclosed, for example, in U.S. Pat. Nos. 3,876,115, 3,731,854, and 3,467,283.

Within the interior of the container formed by the sidewall 4 and base 6 is a volume-expansible member 12, which in this embodiment is an elastomer bag, in the expanded state, i.e., filled with fluid (not shown), shown in cross section in FIG. 1. The elastomer from which member 12 is made is inert and has the ability to resist molecular and other fluid migration therethrough of the particular fluid involved. Unfortunately, elastomers that have these barrier properties with respect to the usual fluids being dispensed do not have the recovery force necessary to cause their dispensing.

The dispensing force in the embodiment of FIG. 1 is provided by an expansible fabric 14 disposed about the volume-expansible member 12. As shown in FIG. 1, the fabric 14 is also in the expanded state so that when cap 8 is depressed to open the valve mechanism to permit fluid to escape from within member 12, the fabric 14 contracts primarily circumferentially to radially decrease the volume within member 12, to force the fluid through the nozzle 10.

Figure 2:
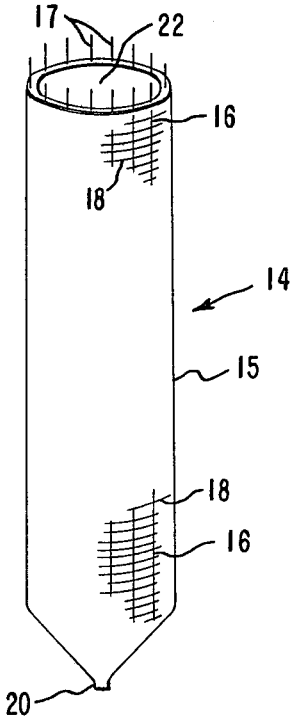
FIG. 2 shows in enlarged side elevation one embodiment of a tubular expansible fabric useful in fluid dispensing containers of the present invention.

FIG. 2 shows a schematic enlargement of fabric 14. Such fabric is in a tubular shape 15 and consists of elastomer yarn 18 in the circumferentail direction of the tubular shape and yarn 16 in the transverse direction which is the axial direction of the tubular shape.

An annular opening 22 is provided in the top of the tubular shape, and the bottom 20 is closed by sewing. The ends 17 of yarns 16 project from the top of the tubular shape 15 surrounding the opening 22. These ends can be used for securing the tubular shape within the container, i.e., instead of the fabric of the tubular shape being secured to the container by appropriate clamping, the ends 17 can be secured by the clamping.

In use, the member 12, which has a shape prior to expansion by filling with fluid similar to but not necessarily congruent with the interior of the tubular shape 15 of the fabric can be inserted through opening 22 into the interior of the tubular shape. The tops of the member 12 and fabric 14 are then secured proximate to the top of container 2 in a conventional manner such as disclosed in U.S. Pat. No. 3,876,115, with the member 12 and fabric 14 extending downward within sidewall 4. Member 12 is then charged with fluid, which has the effect of expanding the volume of member 12 and at the same time stretching the elastomer yarn 18 of fabric 14, and thereby the fabric 14 itself, to permit radial expansion of the tubular shape of the fabric.

The recovery force of the stretched elastomer yarn 18 supplies the contracting force for dispensing the fluid from the member 12.

The transverse direction yarn 16 holds the elastomer yarn 18 in their side-by-side fabric position during expansion to prevent the expanding member 12 from penetrating between yarns 18 and expanding on the exterior of the tubular shape 15, which can be called a blow-out of member 12. Blow-out can occur during expansion of the expansible fabric because the space between adjacent elastomer yarns 18 increases, giving an increased open space in the fabric through which the member 12 can penetrate. Also contributing to this increase in open space is the decrease in diameter of the elastomer yarn during stretching. Finally, there is a tendency for the elastomer yarn to roll over sideways to a position of lesser stretch about the member 12. This yarn rolling over increases the open space in the fabric, especially where adjacent yarns 18 roll over in opposite directions, and once the member 12 enters into this open space, the yarn roll over tendency is motivated even further. The tendency of the yarn 18 to roll over arises from the recovery force of the stretched yarn trying to contract itself, coupled with the small amount of force required to produce roll over as compared to overcoming sliding friction. These effects are overcome by the engagement of the yarn, such as the transverse direction yarn 16, with the elastomer yarn.

Constriction of the bottom 20 of the tubular shape 15 by sewing or by other means such as a clamp, prevents the member 12 from forming a blow-out in that direction.

The expansible fabric such as the tubular shape 15 disposed about the volume-expansible member provides a pressure on the fluid contents of the volume-expansible member of at least 0.15 atm., and preferably at least 0.4 atm., and even more preferably at least 0.8 atm. when the fluid is to be dispensed as a spray. These pressures are present until at least 90% of the fluid is dispensed from the container.

Surprisingly, even though the transverse direction yarn, i.e. the yarn in engagement with the elastomer yarn to maintain its fabric position, may have no appreciable elongation at all, a high degree of expansion of the fabric, preferably at least 150% and more preferably at least 200% is still permitted. Thus, the radius of the tubular shape 15 can be increased by at least 150% and even more than doubled by the elongation of the fabric 14 in the circumferential direction. This fabric stretchability effect can be enhanced by the choice of fabric construction and/or type of yarn 16.

Figure 4:
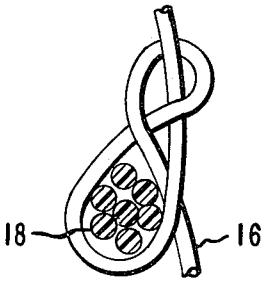
FIG. 4 shows schematically and in further enlargement one embodiment of an intersection of elastomer yarn and another yarn of fabrics used in the present invention, with the elastomer yarn being shown in cross-section.
Figure 5:
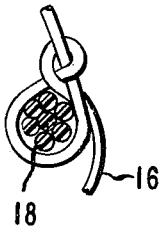
FIG. 5 shows schematically the effect of expanding the fabric on the yarn intersection of FIG. 4.

As for the fabric construction, in some knits, the yarn 16 engaged with the elastomer yarn is formed in a loop around the elastomer yarn 18, such as shown in FIG. 4, at the intersections between these yarns in the knit fabric construction. As the elastomer yarn 18 is stretched during expansion of the tubular shape 15 upon the filling of member 12 with fluid, the cross section of the yarn 18 decreases as shown in FIG. 5. This shortens the path of the loop of yarn 16 around the elastomer yarn 18, which frees additional length of yarn 16 to enable it to bow outwardly to form the expanded shape shown in FIG. 1. Also, as shown in FIGS. 4 and 5, additional length of yarn 16 is made available for bowing by the tightening up of the loop of yarn 16 upon itself even where elastomer yarn 18 is not present.

As for the choice of type of yarn, the outward bowing of the fabric can be enhanced by the use of a yarn 16 which is textured. The texturing of yarn does give the yarn a small degree of stretch, usually less than 100% and more often less than 50%, but no substantial recovery force.

The preferred yarn in engagement with the elastomer yarn to maintain its fabric position is a non-stretch yarn, i.e. a yarn having an elongation of no greater than 100% and preferably no greater than 50%, under the tension applied to the yarn by expansion of the fabric within container 2 and more preferably such elongation is the ultimate elongation. When non-stretch yarn is used, substantially no expansion in the non-stretch yarn direction in the fabric occurs. Thus, when yarn 16 is non-stretch yarn, the tubular shape expands radially but expands much less or not all in the axial direction.

The yarn in engagement with the elastomer yarn to maintain its fabric position can also be an elastomer yarn, but not necessarily having the elongation or recovery force of the first-mentioned elastomer yarn. In this embodiment, much less of the yarn in engagement is used as compared to the elastomer yarn supplying the recovery force to the fabric, and the contractive or recovery force of the fabric used in the present invention is still primarily unidirectional, e.g. circumferential in the embodiment of FIGS. 1 and 2.

The yarn in engagement with the elastomer yarn to maintain its fabric position can be any conventional yarn, textured or untextured. Typically, the yarn will have a denier per cm of fabric width sufficient to withstand the force of the expansion of the volume-expansible member within fabric. Preferred materials from which the yarn is made are polyamide and polyester.

With respect to the elastomer yarn, it preferably has an elongation of at least 300%. Examples of elastomers from which such yarn is made include natural and synthetic rubber and segmented polyurethane, also known as spandex. Segmented polyurethane yarn is further described, for example, in the section entitled "Spandex Fibers" in Saunders and Frisch, *Polyurethanes: Chemistry and Technology, Part II,* published by Interscience Publishers (1964). Some segmented polyurethane yarn is thermoplastic which would permit such yarns, if overlapped, to be held together by fusion, but this is unnecessary in the present invention since the transverse direction yarn holds the fabric together by engagement with the elastomer yarn without requiring fusion. The segmented polyurethane yarns are preferred because they generally have a higher recovery force than rubber threads. Recovery force can be expressed in terms of recovery modulus which takes into account the denier (size) of the yarn. Recovery modulus measures the contractive force of the yarn. For purposes of this invention, recovery modulus is defined as the firstcycle, unload value of stress ("power") at 100% elongation. This recovery modulus is measured as follows: The yarn is stretched from zero to 300% extension at a constant rate of elongation, i.e. 100% per 7 ½ seconds, is held at 300% extension for ½ minute, and upon unloading towards zero elongation at the same rate, the recovery force at 100% elongation is measured and is expressed in terms of grams per denier at 100% elongation. The elastomer yarns used in this invention preferably have a recovery modulus at 100% elongation of at least 0.01 gram per denier, and preferably at least 0.02 gram per denier. The denier in this measurement is the denier at the 100% elongation.

The yarn made from the elastomer is conventional in that it can be made of one or more filamentary strands in which each strand can consist of one or more filaments, but is unusual, especially for spandex elastomer, in that the yarn denier will generally be at least 2000 and preferably at least 8000 in order to provide the recovery force that is necessary for the fabric. Such yarn would normally be formed of multifilamentary strands.

Figure 6:
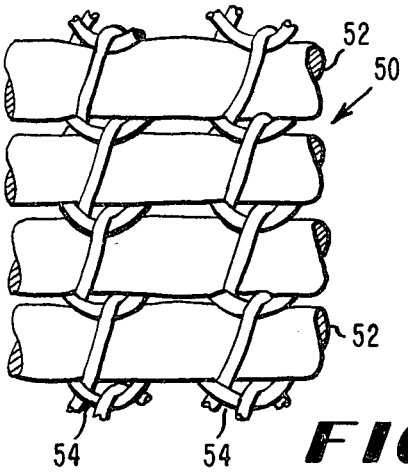
FIGS. 6 and 7 show schematically in enlargement a portion of the surface of several embodiments of expansible fabric of the present invention.
Figure 7:
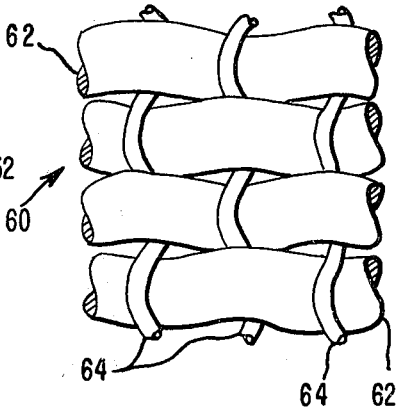

The expansible fabric can be woven, braided, or knit and the knit can be a weft knit or a warp knit (including crochet), with the Raschel knit, which is a warp knit, being preferred. The fabric is preferably made from at least two yarns since this permits concentration of the elastomer yarn in the direction of contraction desired. The fabric can be made into the desired shape such as the tubular shape shown in FIG. 2 during the making of the fabric or the fabric can be made in flat form which is subsequently sewed to form the tubular shape. FIG. 6 shows a knit fabric 50 as one embodiment of the invention, comprising elastomer yarn 52 supplying a contractive force in the sideways direction and yarn 54 in the direction transverse thereto and looped about the yarn 52 at intersections therewith. FIG. 7 shows a woven fabric 60 as another embodiment of fabric of the invention, comprising elastomer yarn 62 interwoven with yarn 64 running in the transverse direction.

Sufficient elastomer yarn is incorporated into the fabric to provide the recovery force desired, which will depend on the recovery modulus of the particular elastomer being used, the denier of the elastomer yarn, the stress decay of the particular elastomer being used, the viscosity of the fluid being dispensed, and the dispensing rate desired for the fluid. Since the yarn transverse to the elastomer yarn direction merely holds the elastomer yarn in its fabric position during expansion and contraction, only a small proportion of such yarn is required in the fabric, depending on the strength of the yarn to resist breakage under the expansion force involved. Preferably, the elastomer yarn supplying the primary recovery force to the expansible fabric will comprise 65 to 98% of the weight of the fabric.

Generally, the relative positions in the fabric of the elastomer yarn and the yarn maintaining the fabric position of the elastomer yarn can be described in terms of yarn direction in the fabric. In this sense, the elastomer yarn direction in the fabric is in the same direction as the primary recovery force of the fabric and is preferably substantially parallel thereto, in order to maximize the recovery force of the fabric. In the same sense, the yarn in engagement with the elastomer yarn runs in a transverse direction thereto.

Description herein of yarn direction of the elastomer yarn in the expansible fabric refers to the direction of primary recovery force of this yarn in the fabric and should be understood not to exclude the possibility of the elastomer yarn having length portions extending in a different direction including even the transverse direction which can occur in complex fabric structures such as knits. Similarly, in the case of braided fabrics a plurality of elastomer yarns can be present in the fabric at an angle usually less than 45° to each other, but the fabric acts essentially as a unidirectional recovery force fabric in the direction of the vector sum of the elastomer yarns. This gives the fabric the combination of expansibility with a high recovery force essentially in only one direction. For example, while the elastomer yarn will run in only one direction in a woven fabric, such yarn might run in a plurality of directions including the direction in which the recovery force is desired in a knit fabric, but nevertheless such knit fabric will have appreciable uni-directional stretch and high recovery force only by virtue of the stitch construction of the transverse direction yarn therein. Similarly, the yarn direction of the transverse direction yarn, such as non-stretch yarn, in the fabric can include directions in addition to the direction transverse to the elastomer yarn direction, but the transverse direction yarn does not prevent the desired expansion of the fabric in the elastomer yarn direction. The angle between the transverse yarn and the elastomer yarn will depend on the fabric construction, and the transverse yarn can include a plurality of transverse yarns at an angle usually less than 45° to each other such as may be present in a braided fabric.

In the case of knit expansible fabrics, the elastomer yarn might not be a part of the stitch of the fabric because it is difficult to form stitches from yarn deniers exceeding 1000. In such cases, the elastomer yarn is incorporated into the fabric by the well known laying in technique wherein the yarn is incorporated into the courses or wales of the fabric while it is being knitted, which places the elastomer yarn in the fabric in the direction parallel to the direction of contractive force desired for the fabric.

The expansible fabric has an elongation of at least 150% and preferably at least 200%. Generally, but not necessarily, the fabric construction is such that the yarn maintaining the fabric position of the elastomer yarn does not limit the elongation of the elastomer yarn, whereby the elongation of the fabric is determined by the elongation of the elastomer yarn along. Thus, fabrics having an elongation of greater than 300% are also provided by the present invention.

Preferably the elastomer yarn imparts to the fabric a recovery force of at least 250 g per cm of fabric width in the cross direction to the elastomer yarn at 100% elongation after unloading from 150% elongation reached at the rate of 100% elongation per 7 ½ seconds and held at 150% elongation for one-half minute and unloaded at the same rate. The size of the fabric sample tested for this property can vary with the size of the expansible fabric being tested. To minimize edge effects, the width of the sample tested is 4 cm. For radially expansible tubular fabric shapes, radial elongation of the fabric can be done by pulling a pair of rods apart, which rods pass axially through the tubular shape. For an axially expansible tubular fabric shape, the opposing ends of such shape are gripped in the jaws of the testing machine. The fabric recovery force values disclosed herein are to be measured by the load and unload technique hereinbefore described. More preferably, the fabric recovery force is at least 750 g per cm of fabric width.

The amount of elastomer yarn required to give the fabric desirable recovery force will generally be at least 20,000 denier per cm of fabric width across the elastomer yarn direction and preferably at least 35,000 denier per cm of fabric width.

As previously described herein, the transverse direction yarn stabilizes the transverse direction of the fabric, especially in the case of non-stretch yarn, and the fabric position of the elastomer yarn in the fabric. Typically, the amount of transverse direction yarn will be from 200 to 10,000 denier per cm of fabric width in the cross direction. Preferably, however, the weight of the elastomer yarn in the fabric will exceed the weight of the transverse direction yarn by at least 6:1. This accounts for the thick, closely spaced elastomer yarns 52 and 62 as compared to the thin, wider spaced yarns 54 and 64 shown in FIGS. 6 and 7, respectively.

An example of a knit expansible fabric of the present invention is as follows: the fabric can be made by knitting on a Comez crochet machine having 14 needles per inch and 7 guide bars of which only bars 2, 4 and 7 are used. Bars 2 and 4 each contain one guide threaded with 2240-denier segmented polyurethane yarn. Bar 7 contains seven guides corresponding to needles 1, 2, 6, 10, 13, 18, and 19 (only these needles are placed in the machine). Bar 7 is threaded with 4-ply, 100-denier, textured nylon yarn at guide positions 1 and 19. Bar 7 is threaded with 2-ply, 100-denier, textured nylon yarn at guide positions 2 and 18. Bar 7 is threaded with 150-denier, textured polyester yarn at guide positions 6, 10, and 13. The following bar movement patterns are employed in knitting the fabric:

Bar 2 1-1/20-20
Bar 4 1-1/20-20
Bar 7 1-0/1-0

The above patterns are given in the warp-knitter's tricot notation. There is obtained a flat, elastic, narrow fabric with weftwise stretch having 8.5 courses of elastomer yarn per centimeter. The fabric consists of 93% by weight of segmented polyurethane yarn at 38000 denier per cm of fabric width across the elastomer yarn direction. The non-stretch yarn is present in the fabric in a nonuniform spacing, but at an average of about 600 denier per cm across the non-stretch yarn direction. The fabric has a recovery force in the elastomer yarn direction of 1040 g per cm of fabric width. Two equally long pieces of this fabric are converted into a tubular structure by joining along the longitudinal edges. Joining is accomplished by conventional machine sewing with polyester thread at eight stitches per centimeter. The resulting elastic, tubular fabric has a radial expansion of 260%.

Instead of sewing together two flat fabrics to make a tubular shape, the tubular shape can be knit directly as follows:

A tubular elastic fabric is knit on a halfgauge, 36-gauge, double needle-bed Raschel knitting machine (18-gauge for needles and guides). Seven guide bars are used to make this fabric. Bars 1, 2, 6, and 7 are threaded with 2240-denier segmented polyurethane yarn. Bar 4 is threaded with 3-ply, 210-denier nylon yarn having a twist of seven turns per inch Z, and bars 3 and 5 are threaded with singles of 210-denier nylon yarn. The segmented polyurethane yarn band is knit on a 9-needle set out (2.54 cm per band). The chain readings for producing the bar movement patterns are as follows, the warp-knitter's Raschel notation being used:

| | A | | | | | | | |
|---|---|---|---|---|---|---|---|---|
| Bar 1 | 0–0 | / | 16–16 | / | 36–36 | / | 20–20 |
| Bar 2 | 36–36 | / | 20–20 | / | 0–0 | / | 16–16 |
| Bar 3 | 4–0 | / | 0–0 | / | 0–4 | / | 4–4 |
| Bar 4 | 4–0 | / | 4–0 | / | 0–4 | / | 0–4 |
| Bar 5 | 4–4 | / | 4–0 | / | 0–0 | / | 0–4 |
| Bar 6 | 20–20 | / | 0–0 | / | 16–16 | / | 36–36 |
| Bar 7 | 16–16 | / | 36–36 | / | 20–20 | / | 0–0 |

The chain readings designated A describe the tube pattern.

There is obtained a laid-in, crossover twofaced fabric tied together at the selvedges, which is a tubular structure containing 83% spandex by weight and having 8 courses and 5 wales per centimeter. It is expansible radially by more than 300%. The spandex yarn and nylon yarns are in the fabric at 36000 and 1100 denier per cm of their respective fabric widths, ignoring selvedge. The fabric has a recovery force in the elastomer yarn direction of 980 g per cm of fabric width.

Another tubular elastic fabric is made by the same procedure as just described, except that the segmented polyurethane yarn in each bar has a denier of 6720 (composed of three yarns, each having a denier of 2240), and the fabric has six courses of such yarn per cm or 81000 denier per cm of fabric width and a recovery force of 2200 g per cm of fabric width.

An elastic tubular woven fabric can be produced directly on a conventional, 4-position ribbon loom using 1000-denier jet-bulked nylon warp yarns and 4480-denier segmented polyurethane filling yarn, in a plain weave pattern. This tubular fabric contains 69% spandex by weight and has 18 warp ends per centimeter and 13 picks per centimeter. This tubular fabric is elastic in the radial direction and has an expansion of 290%. The fabric has a recovery force in the elastomer yarn direction of 1400 g per cm of fabric width. The elastomer yarn is present at 58000 denier per cm of fabric width in the cross direction to the elastomer yarn, and the nylon yarn at 18000 denier per cm of fabric width in the cross direction to the nylon yarn.

A knit fabric knit from two-ply, 100-denier, textured nylon yarn on a 12-cut Dubied Dux model flatbed knitting machine using alternate needles only in a rib stitch. The fabric is removed from the machine and held in a partially extended state widthwise while 8960 denier segmented polyurethane yarn composed of two ends of 4480 denier segmented polyurethane yarn are laid in between the wales at 1.5× stretch, alternately weaving over and under the nylon yarn courses. The ends of the segmented polyurethane yarns are secured from slipping and the fabric is steamed for 45 seconds in order to relax the knit structure. These is obtained a flat, weft-knit elastic fabric which has 200% elongation in the walewise (elastomer yarn) direction. It contains 88% segmented polyurethane yarn by weight and has 5.5 courses and 3.5 wales per centimeter. The segmented polyurethane yarn is present in the fabric at 31000 denier per cm of fabric width in the cross direction to the elastomer yarn and the nylon yarn is present at 1100 denier per cm of fabric width in the cross direction to the nylon yarn. The fabric in the elastomer yarn direction has a recovery force of 760 g per cm of fabric width.

By sewing together along the walewise edges, the above-described flat fabric can be converted into a tubular fabric which is elastic in the axial direction and has an axial expansion of 200%. Alternatively, a tubular fabric having axial elasticity may be produced directly on a circular knitting machine with warp inlay capability, such as the VEEV machine made by Rockwell International Corporation of Reading, Pa.

The fabric recovery forces reported for these fabrics described in detail are calculated from the recovery force of the segmented polyurethane yarn used, which is 61 g for the 2240 denier yarn and 108 g for the 4480 denier yarn, which is measured as follows: the yarn is stretched from zero to 150% at the rate of 100% per 7½ sec., held at 150% stretch for one-half minute, and then unloaded towards zero elongation, and the recovery force taken at 100% elongation during the unloading. The fabric recovery force is obtained by multiplying the yarn recovery force times the number of ends of yarn present per cm of fabric width, measured in the cross direction to such yarn. This calculation method gives results close to the actual measurement of fabric recovery force. For example, the measured recovery force of the tubular woven fabric was 1380 g per cm of fabric width at 100% elongation. The transverse direction yarns used to make these fabrics all had an elongation of substantially less than 100%.

An aid to obtaining a high degree of dispensing of fluid from member 12 is the use of a mandrel such as the tapered cruciform cross-section mandrel 30 shown in FIG. 1 and described in detail in U.S. Pat. No. 3,876,115. The fabric 14 contracts sufficiently that it forces member 12 against the mandrel on all sides to force the fluid towards the valve mechanism outlet of member 12. In such case, the unexpanded diameter of the tubular shape 15 would be less than the diameter of the mandrel. The unexpanded diameter of member 12 can also be less than the diameter of the mandrel to aid in inserting the member 12 into the interior of the tubular shape 15 of the fabric prior to filling with fluid. For example, the mandrel can have a diameter ranging from 1.2 to 1.4 cm and the diameter of the tubular shape prior to disposition about the mandrel can be 1.2 cm in diameter. In place of the mandrel, other means can be present to occupy a volume which is greater than the volume within the volume-expansible member prior to filling with fluid and with the expansible fabric disposed thereabout, which minimizes the residue of fluid in the container after dispensing ceases.

As stated hereinbefore, the use of expansible fabric enables all the contracting force to be applied where the contraction is needed, namely, in the circumferential direction as shown in FIG. 1. An additional benefit is that the lengthwise dimensional stability imparted to the tubular shape 15 by yarn 16, when non-stretch, coupled with the closing of the bottom 20 of the tubular shape, forms a smooth, safe bottom for the volume-expansible member 12. Thus a special bottom in place of bottom 6 for the container 2 is not needed. Alternatively, the bottom of the tubular shape need not be closed and blow out can be avoided by making the tubular shape somewhat longer than the member 12 and/or by constricting but not closing the diameter of the portion of the tubular shape extending beyond the end of member 12. Of course, since an aerosol propellant is not involved, the sidewall 4 and bottom 6 can be constructed of lightweight inexpensive materials such as polyethylene and can be either a unitary structure such as shown in FIG. 1 or can be assembled from a separate sidewall 4 and bottom 6.

If a mandrel such as mandrel 30 or other volume-occupying means is present in the dispensing container, the length of the mandrel can be such that it substantially reaches the bottom 20 of the tubular shape of the fabric 14, taking into account the presence of member 12 therebetween as shown in FIG. 1. In such case, the mandrel prevents the fabric from shortening in the direction of cap 8 during expansion, and the bottom side of the expanded fabric forms a conical shape, having an approximately V-shaped cross section shown in FIG. 1. If the mandrel is omitted or is sufficiently short or if the tubular shape has sufficient elongation in the axial direction, the fabric will form a more rounded bottom upon expansion.

In another embodiment of the present invention, the member 12 can be a non-elastomer material, e.g., a film bag which has the appropriate inertness and barrier properties and which can be stuffed into the tubular shape 15 prior to filling of the bag. In this embodiment, too, the fabric 14 exerts the appropriate contracting force to cause fluid to be dispensed from the nonelastomer volume-expansible member. This embodiment is useful with or without the presence of a mandrel or other volume-occupying means in the dispensing container.

Figure 3:
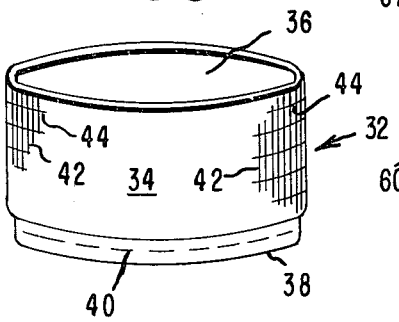
FIG. 3 shows in enlarged side elevation another embodiment of a tubular expansible fabric useful in fluid dispensing containers of the present invention.

The principle of applying the contracting force in the direction only where contracting is needed is applicable to interchanging the directions of elastomer yarn and transverse direction yarn to obtain, for example, a fabric 32 of tubular shape 34 having an annular opening 36 at the top and closed at the bottom 38 such as by sewing along line 40, wherein the elastomer yarn 42 is in the axial direction and the transverse direction yarn 44 is in the circumferential direction, as shown schematically in FIG. 3. This embodiment is designed for expansion and contraction primarily in the axial direction of the tubular shape. One embodiment of the usefulness of this fabric embodiment is to be used in place of or disposed about the protective bag 27 which surrounds the accordion-type bag of the aerosol fluid dispensing container disclosed in U.S. Pat. No. 3,828,977. This would have the advantage of converting the aerosol dispenser of that patent to a non-aerosol dispenser. The opening 36 of the annular shape is preferably large enough to receive the accordion-type bag and can be secured therewith in the container in the same manner as disclosed for protective bag 27 in that patent.

Similarly, the properly sized tubular shape 15 of FIG. 2 could be used to contract against the accordion-type bag of U.S. Pat. No. 3,731,854 when circumferential contracting force is needed. This substitution would convert the aerosol dispenser of that patent to a non-aerosol dispenser.

The fluid dispensing container of the present invention can be used to dispense the usual fluids dispensed by the hand held aerosol dispensers and the non-aerosol, elastomer bag type dispensers heretofore. Generally, the fluid which can be considered a liquid will have a viscosity of 0.5 to 2000 centipoises at 30°C., the particular viscosity being fixed by the choice of the product to be dispensed and/or selected to obtain the kind of dispensing desired. For example, a fluid to be dispensed as a spray should have a low viscosity.

Since many different embodiments of the invention may be made without departing from the spirit and scope thereof, it is to be understood that the invention is not to be limited except to the extent defined in the following claims.

What is claimed is:

1. In a fluid dispensing container comprising a volume-expansible member for receiving and holding said fluid and means for forcing said volume-expansible member to contract in volume so as to dispense said fluid therefrom, the improvement comprising an expansible fabric disposed about said volume-expansible member and having a uni-directional recovery force to contract said volume-expansible member sufficiently to substantially empty it of said fluid, thereby serving as said forcing means, said fabric comprising elastomer yarn supplying said recovery force to said fabric and yarn in engagement with said elastomer yarn to maintain the position of said elastomer yarn in the fabric during expansion and contraction of said fabric so as to prevent blow-out of said volume-expansible member.

2. In the fluid dispensing container of claim 1 wherein said fabric is tubular in shape.

3. In the fluid dispensing container of claim 2 wherein the direction of contraction is primarily along the axis of the tubular shape of the fabric and the elastomer yarn is in said direction in said fabric.

4. In the fluid dispensing container of claim 2 wherein the direction of contraction is primarily in the circumference of said tubular shape of the fabric and the elastomer yarn is in said direction in said fabric.

5. In the fluid dispensing container of claim 2 wherein the end of the tubular shape of the fabric away from the end where the fluid is dispensed is constricted.

6. In the fluid dispensing container of claim 1 wherein said fabric is a knit fabric.

7. In the fluid dispensing container of claim 1 wherein the yarn maintaining the position of the elastomer yarn in the fabric is non-stretch yarn.

8. In the fluid dispensing container of claim 1 wherein said elastomer yarn is present in said fabric at at least 20,000 denier per cm of fabric width in the cross direction to the elastomer yarn.

9. In the fluid dispensing container of claim 8 wherein said fabric has a recovery force at 100% elongation of at least 250 g per cm of fabric width in the cross direction to the elastomer yarn.

10. In the fluid dispensing container of claim 9 wherein said elastomer yarn has a denier of at least 8000.

* * * * *

UNITED STATES PATENT OFFICE

CERTIFICATE OF CORRECTION

Patent No. 3,981,415 Dated September 21, 1976

Inventor(s) John Rayford Fowler et al.

It is certified that error appears in the above-identified patent and that said Letters Patent are hereby corrected as shown below:

Figures 4 and 5 should be cancelled and Figures 4 and 5 as shown below substituted therefor.

FIG. 4

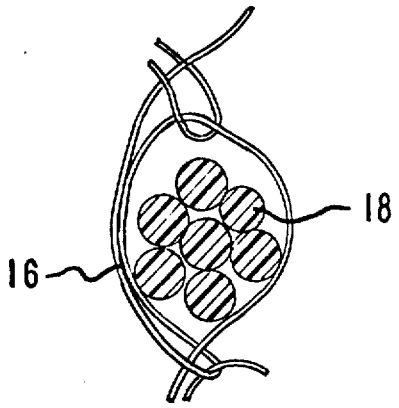

FIG. 5

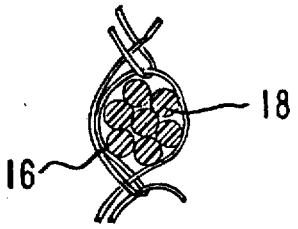

Signed and Sealed this

First Day of March 1977

[SEAL]

Attest:

RUTH C. MASON
*Attesting Officer*

C. MARSHALL DANN
*Commissioner of Patents and Trademarks*